United States Patent [19]

Rozenfeld et al.

[11] 3,967,926

[45] July 6, 1976

[54] METHOD FOR INHIBITING THE CORROSION OF METALS WITH VAPOR PHASE INHIBITORS DISPOSED IN A ZEOLITE CARRIER

[76] Inventors: Iosif Lvovich Rozenfeld, ulitsa Gubkina, 4, kv. 96; Viveya Pavlovna Persiantseva, ulitsa Krasikova, 19, kv. 3; Jury Igorevich Kuznetsov, ulitsa Dovatora, 1/28, kv. 7; Nikolai Mikhailovich Petrov, ulitsa Petrovka, 20, kv. 30, all of Moscow, U.S.S.R.

[22] Filed: Nov. 9, 1973

[21] Appl. No.: 414,428

[52] U.S. Cl. ..... 21/2.5 B; 239/54

[51] Int. Cl.[2] ..... C23F 11/02; C23F 11/14

[58] Field of Search ..... 21/2.5 B; 239/53, 54

[56] References Cited

UNITED STATES PATENTS

| | | | |
|---|---|---|---|
| 2,521,311 | 9/1950 | Schwoegler et al. | 21/2.5 B |
| 2,577,219 | 12/1951 | Wachter et al. | 21/2.5 B |
| 2,643,176 | 6/1953 | Wachter et al. | 21/2.5 B |
| 2,643,178 | 6/1953 | Wachter et al. | 21/2.5 B |
| 2,717,843 | 9/1955 | Wachter et al. | 21/2.5 B UX |
| 2,778,774 | 1/1957 | Buslik | 239/54 |

OTHER PUBLICATIONS

"Thorpe's Dictionary of Applied Chemistry", 4th Ed, vol. XI, 1954, pp. 1038–1044, Longmans, Green, and Co.

H. R. Baker, "Volatile Rust Inhibitors", 3–1954, pp. 4, 6–8, 14 and 15, Naval Research Laboratory.

Hackh's Chem. Dictionary, 1969, pp. 35, McGraw–Hill.

*Primary Examiner*—Morris C. Wolk
*Assistant Examiner*—Bradley R. Garis
*Attorney, Agent, or Firm*—Haseltine, Lake & Waters

[57] ABSTRACT

A method for inhibiting the atmospheric corrosion of metals in a sealed space with inhibiting amounts of vapor phase inhibitors consisting of disposing in said sealed space a carrier means for storing a stock of inhibitors and diffusing their vapors wherein said carrier means is silica gel or zeolite and contains a liquid inhibitor selected from the group consisting of primary, secondary and tertiary amines and mixtures thereof.

7 Claims, No Drawings

METHOD FOR INHIBITING THE CORROSION OF METALS WITH VAPOR PHASE INHIBITORS DISPOSED IN A ZEOLITE CARRIER

The present invention relates to protecting metals against atmospheric corrosion and more particularly to protecting the surface of metal products against atmospheric corrosion by vapor phase inhibitors in a sealed space.

In connection with the intensive development of technology, longer transport traffic distances, necessity of preserving products for longer periods of time, the problem of protecting metal products against atmospheric corrosion acquires a major significance.

One of the ways of protecting metal products against atmospheric corrosion consists in establishing a contact between the metal surface and the medium containing corrosion inhibitors.

The contact is established in a closed space formed by the packaging or the product itself by introducing to the said medium, — generally air, — easily-vaporized substances of inhibiting capacity. By adsorption on the surface of the metal products, the vapors of the volatile substances act upon the electrochemical reactions taking place at the surface of the metals, thereby preventing or reducing corrosion.

The known methods for protecting metal products against atmospheric corrosion by vapor phase inhibitors do not meet the requirements imposed by long-period storage of various metal products.

A method is known in the prior art for protecting metals against atmospheric corrosion by supplying air or an inert gas saturated with vapors of a volatile inhibitor, an amine, which is vaporized from a special tray, into the internal cavities of the product. (U.S. Pat. No. 3,084,022, 1963). Another method involves wrapping up the metal product in a packaging material impregnated with a volatile inhibitor, an amine and subsequently placing the product in the closed space formed by the packaging or placing the packaging material saturated with a volatile inhibitor in the internal cavity of the product, this being followed by sealing the product itself.

A disadvantage of the first method is that the method does not eliminate but provides for the condensation of the inhibitor on the surface of the product which is undesirable in a number of cases, e.g. when protecting radiotechnical or electronic equipment. In addition, passing air or an inert gas saturated with vapors of the inhibitor through the product requires a special device.

A disadvantage of the second method is related to the fact that it is rather difficult and sometimes impossible to introduce the required amount of the inhibitor into the packaging material to provide continous protection against corrosion. When introducing, for instance, liquid inhibitors into paper in amounts exceeding a definite rate, the latter gets wet, thereby impairing its physico-mechanical properties, it is easily torn, sticks to the surface of the product and to hands and rapidly gets dirty.

The introduction of crystal inhibitors into the packaging material is not commonly practiced either because of the crystalization and subsequent flaking of the inhibitor from the carrier.

To protect large-size products using a volatile inhibitor on paper is made rather difficult because of the necessity of introducing a large amount of carrier into the closed space and spending time unproductively for its location.

the utilization of paper as a carrier of vapor phase inhibitors for a number of products is quite impossible due to the lack of free space in them wherein such a non-compact carrier as paper may be placed.

Besides, a number of modern electronic instruments and other devices cannot tolerate contact between some of their components or units and foreign objects, such as hairs, dust, etc. When utilizing paper as a carrier for the vapor phase inhibitor, the latter requirement cannot always be satisfied, thereby considerably narrowing scope of application of the volatile inhibitors protecting metals against corrosion.

Besides, the packaging material has generally a small specific surface as a result of which the inhibitor vaporization speed and the saturation of the closed space with its vapors are lowered making this method unsuitable for protecting large-size products against corrosion.

An object of the present invention is to eliminate the above mentioned disadvantages.

The principal object is to provide a method for protecting metal products against atmospheric corrosion by means of vapor phase inhibitors which would make it possible to protect metal products of complex configurations, tightly-arranged precision and large-size products for a long period of time and under severe climatic conditions.

This object has been accomplished in a method for protecting surfaces of metal products against atmospheric corrosion in a sealed space by vapor phase inhibitors, amines, on a porous carrier, wherein, according to the invention, use is made of silica gels and zeolites as porous carriers.

The said object was accomplished by proposing in a method for protecting the surface of metal products in a sealed space by vapor phase inhibitors, wherein, according to the invention, there is placed in the sealed space a porous carrier selected from the group consisting of silica gels, zeolites and containing a vapor phase inhibitor selected from the group consisting of primary, secondary and tertiary amines, mixtures of the said amines, derivatives of the amines. silica gels and zeolites have a high absorbing capacity which makes it possible to provide a large store of vapor phase inhibitor with a small volume of the porous carrier. The availability of a developed surface of the carrier, the silica gels and zeolites, ensures rapid vaporization of the volatile inhibitor and provides a practically constant concentration of the inhibitor vapors in the surrounding space.

The silica gels with pores having a diameter from 20 to 140 A and zeolites with pores having a diameter from 4 to 15 A are used, according to the invention, as porous carriers.

The vapor phase inhibitors are primary amines (cyclohexylamine, benzylamine), secondary amines (hexalthyleneamine, dicyclohexylamine), tertiary amines (triethylamine, tributylamine) and their derivatives (triethanolamine, cyclohexylamine carbonate), as well as mixtures of the above-mentioned amines.

The amount of the vapor phase inhibitor applied to the porous carrier is determined by the nature of the inhibitor (vapor pressure of its vapors over the carrier, protective capacity) and constitutes, according to the invention, 0.01–1g per 1g of the carrier. The amount of porous carrier containing the inhibitor is determined by the term of protection and the degree of sealing the space and constitutes, according to the invention, 10–100 g per $m^3$ of the sealed space. If continuous protection for metal product is required, the amount of the inhibitor on the carrier may constitute up to 500 g per $m^3$.

The silica gels and zeolites dried at 200°–300°C and cooled in a closed vessel up to 15°–20°C are immersed into the vapor phase inhibitor or its solution in an organic solvent (spirits, acetone), with removal of the released heat.

It is also possible to supply the vapor phase inhibitor or its solution to the silica gel or zeolite by portions when cooled, either to complete saturation, or to introduce the pre-determined amount of inhibitor into them. Owing to the high adsorbtion capacity of the silica gel and zeolite, they are rapidly saturated with the inhibitor.

The excess amount of the inhibitor is removed by natural drying in the open air or by passing through rollers with filter paper or other material which absorbs liquid well. Silica gel or zeolite is placed into perforated cartridges fabricated from organic glass, cardboard or other material not interacting with the inhibitor. The cartridge is placed in any location of the product irrespective of the distance to the surface of the metal to be protected. It is also possible to locate the cartridge in a closed space formed by a polyethylene case or a case from any other barrier material wherein the product to be protected is comprised. Having inserted the cartridge with the silica gel or zeolite carrying the vapor phase inhibitor, the product is sealed. Owing to the developed surface of the porous carrier, the inhibitor vaporizes quickly reaching any place of the metal surface to be protected, and adsorbing thereon protects it against corrosion. In spite of a small volume of the porous carrier (from 10 g to 100 g per $m^3$ of the sealed space), it contains from 0.1 to 100 g of the inhibitor, and therefore the concentration of inhibitor vapors in the sealed space is continuously maintained at the required level, thereby preventing the appearance of corrosion during the whole period of storage and transportation of the products.

For this reason the method is convenient and simple for use in protecting large-size and extra-long structures.

The possibility of utilizing small volumes of the carrier with a high content of inhibitor therein makes it possible, according to the invention, to protect tightly-packed products which cannot be protected by an inhibitor on paper.

The possibility of controlling the vapor pressure of in the proposed method prevents the condensation of the inhibitor on the surface of the products which is quite necessary when protecting products of the radiotechnical and electronic industries.

The carriers used in the method are commercially produced in large amounts and wide assortment, and the fabrication of cartridges is accomplished by an easily accessible means without requiring high capital expenditures.

Therefore, the proposed method is simple, convenient and economical.

It is possible to carry out the method in the following manner.

A porous carrier, for example, the silica gel is heated at a temperature of 200°–300°C for a period of 3–5 hours, then it is cooled in a closed vessel having a water jacket for cooling. The liquid inhibitor or its solution (in spirits, acetone or other organic solvents) is poured out into the vessel to a level exceeding that of the silica gel. In so doing, the vessel is cooled with water at a temperature of 10°–15°C, and the silica gel is stirred. After such treatment generally not exceeding 3–5 hours, the carrier is removed from the vessel and the excess amount of the inhibitor is removed from its surface (by means of drying in the air, vacuum, by passing through rollers with filter paper or fabric, etc.).

The carrier thus prepared is packed into perforated cartridges made, for example, of organic glass to be located in a closed space, for example, in the inner cavity of a steam boiler kept in storage as a reserve one for a long period of time in the atmosphere of an industrial enterprise.

The small openings or hatches available in such a product render, in this case, the utilization of the inhibitor on paper impossible because of low sorption capacity of the paper and its incompactness, but does not prevent the application of the method according to the invention. Corrosion was not observed during three years of storage.

The method of the invention is utilized to protect against atmospheric corrosion tightly packed electronic precision instruments for which direct contact with the carrier is undesirable, because dust, hairs, crystals or droplets of inhibitor can remain on the surface of the instrument elements. In this case, paper cannot be used because of its physicomechanical properties. A cartridge with silica gel treated with an inhibitor is fastened to the rear panel of the instrument. The instrument is placed into a polyethylene case.

Owing to the high sorption capacity of the carrier, it is possible to introduce into the instrument an amount of vapor phase inhibitor sufficient to protect it. Deslushing is not required to make the instrument operable. The instrument was located on the deck of a ship that was at sea for 10 months under conditions of tropical climate, with no corrosion of metal surfaces being detected.

Other objects and advantages of the method will become apparent from the examples given below.

EXAMPLE I.

Silica gel with a diameter equal to 140°A is heated for three hours at a temperature of 250°C and then cooled up to 20°–30°C in a vessel. The vessel with the cooled silica gel is placed in a water jacket with a water temperature of 7°–10°C, with cyclohexylamine inhibitor being added to the silica gel by portions until the silica gel is fully saturated with the inhibitor. As this takes place, the silica gel is stirred and then dried.

The silica gel thus prepared is placed in a perforated cartridge made from organic glass. The cartridge is located at some distance from the surface to be protected or in a closed space formed by a polyethylene film wherein the product to be protected, i.e. the electronic precision instrument, is located.

The closed space is sealed and the item to be protected is held for testing under severe conditions of sea tropical climate for 10 months.

The cartridge prepared as has been described above is located in the internal cavity of a steam boiler with a cubic capacity of approximately 10 $m^3$, the boiler is sealed and left for storage for three years in the atmosphere of an industrial enterprise.

The results of the tests are illustrated in the table.

EXAMPLE 2.

Under the conditions of Example 1, the vessel with the cooled silica gel is placed in a water-cooling bath, and a liquid inhibitor taken in excess is poured over the silica gel. After two hours of mixing, the excess inhibitor is drained off, and the silica gel is dried in the air.

EXAMPLE 3.

Under the conditions of Example 2, the silica gel after draining off the excess inhibitor is dried by passing through rollers with filter paper or fabric.

as the results of the tests of Examples 1–18 are presented in Table I.

As can be noted from the results of testing the proposed method for protecting metal products against atmospheric corrosion by vapor phase inhibitors given in the table, the method provides an effective protection for metal products under severe conditions of storage for a long period of time.

TABLE I

Results of testing the method for protecting metal surfaces of products against atmospheric corrosion

| Example No. | Porous carrier | Diameter of pores A | Vapor phase inhibitor | Amount of carrier with inhibitor in g per m³ | Amount of inhibitor on the carrier in g per one g. | Area of metal surface not subjected to corrosion in % — Sea climate for 10 months: Iron, steel, cast iron | Copper and its alloys | Zinc | Coatings: Nickel | Chrome | Industrial atmosphere for three years: Iron, steel, cast iron | Copper and its alloys | Zinc | Coatings: Nickel | Chrome |
|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 |
| 1–3 | Silica gel | 140 | Cyclohexylamine | 100 | 0.80–1.0 | 100 | | | | | 100 | | | | |
| 4 | " | " | " | " | 0.009–0.01 | 100 | | | | | 100 | | | | |
| 5 | " | " | Diethylamine | 80 | 0.80–1.0 | 100 | | | | | 100 | | | | |
| 6 | " | " | " | " | 0.009–0.01 | 100 | | | | | 100 | | | | |
| 7 | " | " | Triethylamine | 10 | 0.80–1.0 | 100 | | | | | 100 | | | | |
| 8 | " | " | " | " | 0.009–0.01 | 100 | | | | | 100 | | | | |
| 9 | " | 46 | Benzylamine | 60 | 0.55–0.60 | 100 | | | | | 100 | | | | |
| 10 | " | " | Monoethanolamine + Dicyclohexylamine | " | 0.55–0.60 | 100 | 80 | 70 | 100 | 100 | 100 | 80 | 70 | 100 | 100 |
| 11 | " | " | Hexamethylenamine + Dicyclohexylamine | " | 0.55–0.60 | 100 | | | 100 | 100 | 100 | 70 | 100 | 100 | 100 |
| 12 | " | 20 | Dicyclohexylamine | 80 | 0.30–0.40 | | | | | | 100 | | | | |
| 13 | " | " | Morpholine | " | 0.80–1.0 | 100 | 90 | 70 | 100 | 100 | 100 | 90 | 70 | 100 | 100 |
| 14 | " | " | Piperidine | " | 0.01–0.015 | 100 | | | | | 100 | | | | |
| 15 | Zeolite | 15 | Isopropylamine | 100 | 0.35–0.40 | 100 | | | | | 100 | | | | |
| 16 | " | 15 | Diethylamine + Dicyclohexylamine | 60 | 0.35–0.40 | 100 | | | | | 100 | | | | |
| 17 | " | 4 | Diethylamine | " | 0.30–0.35 | 100 | | | | | 100 | | | | |
| 18 | " | 4 | Ethylamine | 40 | 0.30–0.35 | 60 | | | | | 80 | | | | |
| | Paper | — | Hexamethylenamine | 60 | 0.5 | | | | | | | | | | |

EXAMPLE 4.

Under the conditions of Example 1, the vapor phase inhibitor is introduced into the silica gel by portions until saturation is reached, in terms of 0.01 g per 1g of silica gel.

EXAMPLES 5–18 see Table I.

The conditions for the method of protection, the designation of the metal surface to be protected, as well

What is claimed is:

1. A method for inhibiting the atmospheric corrosion of metals in a sealed space with a corrosion-inhibiting amount of vapor phase inhibitors consisting of disposing in said sealed space a carrier means for diffusing the vapors of said inhibitors, said carrier means consisting of zeolites, and said carrier means containing a liquid inhibitor selected from the group consisting of primary, secondary and tertiary amines, and mixtures thereof.

2. A method as claimed in claim 1 wherein the amount of the said porous carrier means plus said vapor phase inhibitor constitutes from 10 to 100 g per 1 $m^3$ of the sealed space.

3. A method as claimed in claim 1 wherein the amount of the vapor phase inhibitor constitutes from 0.01 g to 1 g per 1 g of the said porous carrier means.

4. A method as claimed in claim 3 wherein the amount of the said porous carrier means plus said vapor phase inhibitor constitutes from 10 to 100 g per 1 $m^3$ of the sealed space.

5. A method as claimed in claim 1 wherein said carrier means consists of zeolites having pores with a diameter in the range of from 4 to 15 A.

6. A method as claimed in claim 5 wherein the amount of the vapor phase inhibitor constitutes from 0.01 g to 1 g per 1 g of the said porous carrier means.

7. A method as claimed in claim 6 wherein the amount of the said porous carrier means plus said vapor phase inhibitor constitutes from 10 g to 100 g per 1 $m^3$ of the sealed space.

* * * * *